US005285532A

United States Patent [19]

Sealy

[11] Patent Number: 5,285,532

[45] Date of Patent: Feb. 15, 1994

[54] PORTABLE URINAL DEVICE

[76] Inventor: E. R. Sealy, 2850 W. 24th St., Apt. 8C, Brooklyn, N.Y. 11224

[21] Appl. No.: 962,699

[22] Filed: Oct. 19, 1992

[51] Int. Cl.[5] ..... A47K 11/12

[52] U.S. Cl. ..... 4/144.3; 4/144.1

[58] Field of Search ..... 4/114.1, 144.1, 144.2, 4/144.3, 301, 462, 463, 480; 220/254

[56] References Cited

U.S. PATENT DOCUMENTS

| | | | |
|---|---|---|---|
| 105,979 | 8/1870 | Price | 4/144.1 |
| 137,214 | 3/1873 | Knight et al. | 4/144.3 |
| 1,440,765 | 1/1923 | Buckley | 4/144.1 |
| 2,764,199 | 9/1956 | Tupper | 220/254 |
| 3,000,015 | 9/1961 | Hart | 4/144.3 |
| 4,683,598 | 8/1987 | Jones | 4/144.1 X |
| 5,040,248 | 8/1991 | Kelly | 4/462 |

FOREIGN PATENT DOCUMENTS

| | | | |
|---|---|---|---|
| 0139131 | 2/1920 | United Kingdom | 4/144.1 |

*Primary Examiner*—Robert M. Fetsuga
*Attorney, Agent, or Firm*—Michael I. Kroll

[57] ABSTRACT

An improved portable urinal device is provided which consists of a structure for holding urine therein. A mechanism is for channeling the flow of urine discharged from a body of a person. An apparatus is for suspending the urine channeling mechanism above the urine holding structure. A conduit is for fluidly connecting the urine channeling mechanism to the urine holding structure, so that the urine discharged from the body of the person can go directly into the urine holding structure.

7 Claims, 2 Drawing Sheets

PORTABLE URINAL DEVICE

BACKGROUND OF THE INVENTION

1. Field of the Invention

The instant invention relates generally to toilet facilities and more specifically it relates to an improved portable urinal device.

2. Description of the Prior Art

Numerous toilet facilities have been provided in prior art that are adapted to be utilized for the disposal of urination and defecation by the flushing of water therefrom. While these units may be suitable for the particular purpose to which they address, they would not be as suitable for the purposes of the present invention as heretofore described.

SUMMARY OF THE INVENTION

A primary object of the present invention is to provide an improved portable urinal device that will overcome the shortcomings of the prior art devices.

Another object is to provide an improved portable urinal device that can be used by an incapacitated person, so that the device can hold urine discharged from the body of the person directly thereto.

An additional object is to provide an improved portable urinal device in which the device is so constructed that it can be used by either a male or female person.

A further object is to provide an improved portable urinal device that is simple and easy to use.

A still further object is to provide an improved portable urinal device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2:
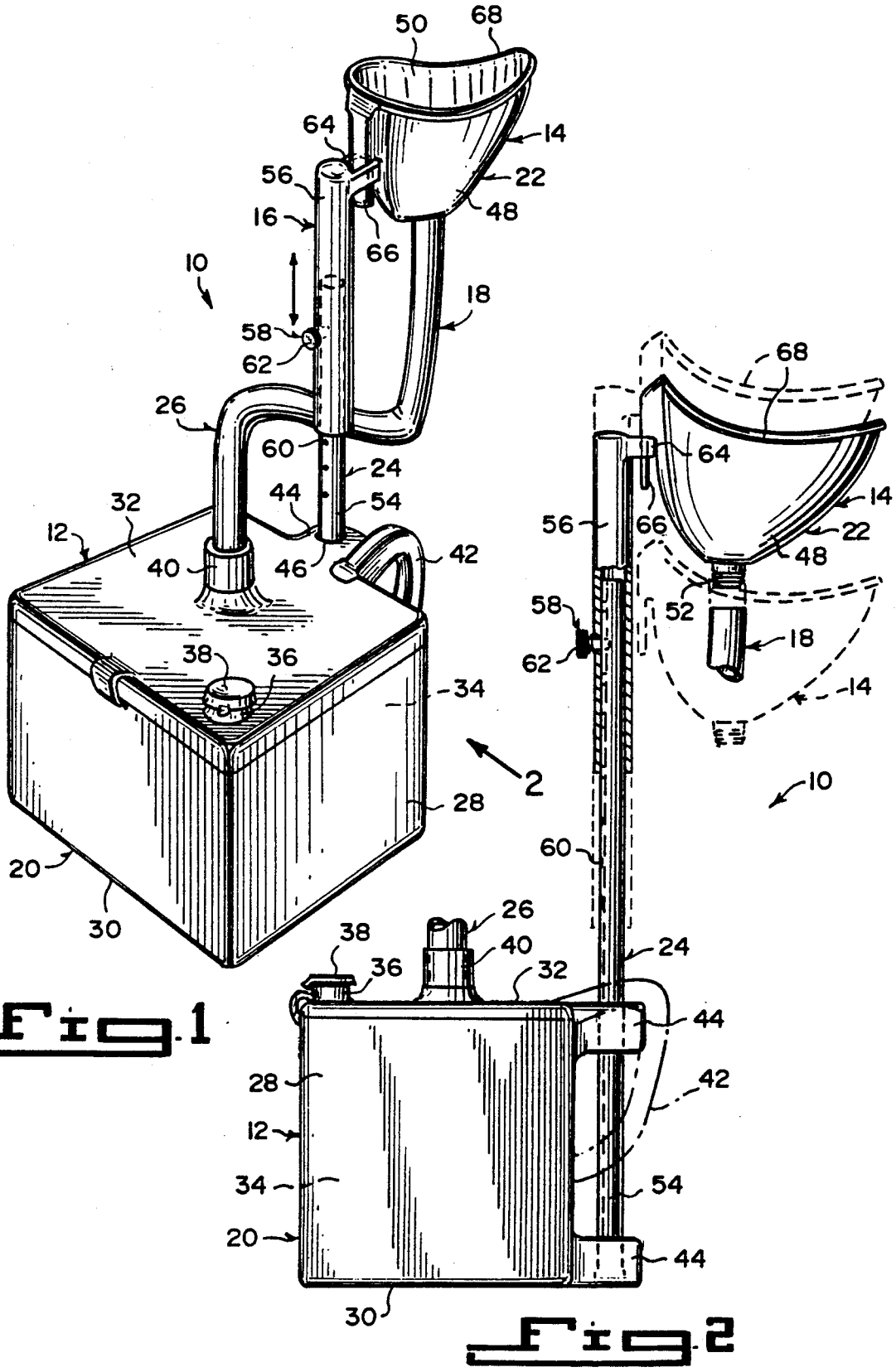
FIG. 1 is a perspective view of the instant invention.
FIG. 2 is a side view with parts broken away taken in direction of arrow 2 in FIG. 1.

Turning now descriptively to the drawings, in which similar reference characters denote similar elements throughout the several views, the Figures illustrate an improved portable urinal device 10 which consists of a structure 12 for holding urine therein. A mechanism 14 is for channeling the flow of urine discharged from a body of a person. An apparatus 16 is for suspending said urine channeling mechanism 14 above the urine holding structure 12. A conduit 18 is for fluidly connecting the urine channeling mechanism 14 to the urine holding structure 12, so that the urine discharged from the body of the person can go directly into the urine holding structure 12.

The urine holding structure 12 is a container 20. The channeling mechanism 14 is a urine funnel cup 22. The suspending apparatus 16 is a stanchion 24 coupled between one side of the container and the urine funnel cup 22. The fluidly connecting conduit 18 is an elongated flexible tube 26 extending between the bottom of the urine funnel cup 22 and the top of the container 20, so as to convey the urine from the urine funnel cup 22 into the container 20 by the force of gravity therebetween.

The container 20 includes an upstanding side wall 28 thereabout, a bottom wall 30 and a top wall 32, so as to form a chamber 34 for holding the urine therein. A neck is formed on the top wall 32 of the container 20 with the neck 36 having an orifice for emptying the urine out of the chamber when full, while a snap on cap 38 is for covering the orifice of the neck 34.

A connector 40 is disposed on the top wall 32 of the container 20, so that a lower end of the elongated flexible tube 26 can be attached to the connector 40. A handle 42 extends from the upstanding side wall 28, so that the container 20 can be carried by the handle 42. A pair of ears 44 are spaced apart and extend from the upstanding side wall 28, one below the other. Each ear 44 has a transverse hole 46 therethrough, with the holes 46 aligned so that a lower portion of the stanchion 24 extends through the holes to be retained by the ears 44.

The urine funnel cup 22 contains a tapered housing 48 with a wide open mouth at the top and a small externally threaded pipe 52 extending from the bottom. An upper end of the elongated flexible tube 26 can be attached to the small externally threaded pipe 52.

The stanchion 24 is height adjustable and includes an elongated rod 54 retained by the ears 44 on the side wall 28 of the container 20. A sleeve 56 is sized to slide upon the elongated rod 54. A mechanism 58 is for retaining the sleeve 56 to the elongated rod 54.

The retaining mechanism 58 consists of the elongated rod 54 having a plurality of longitudinal spaced apart small apertures 60 therein. A set screw 62 is threadable through a side of the sleeve 56 to engage with any one of the small apertures 60 in the elongated rod 54.

A loop 64 extends outwardly from a top end of the sleeve 56. A hook 66 extends downwardly from the wide open mouth on the tapered housing 48 of the urine funnel cup 22, so that the hook 66 can engage with the loop 64 to suspend the urine funnel cup 22 therefrom.

Figures 3, 4:
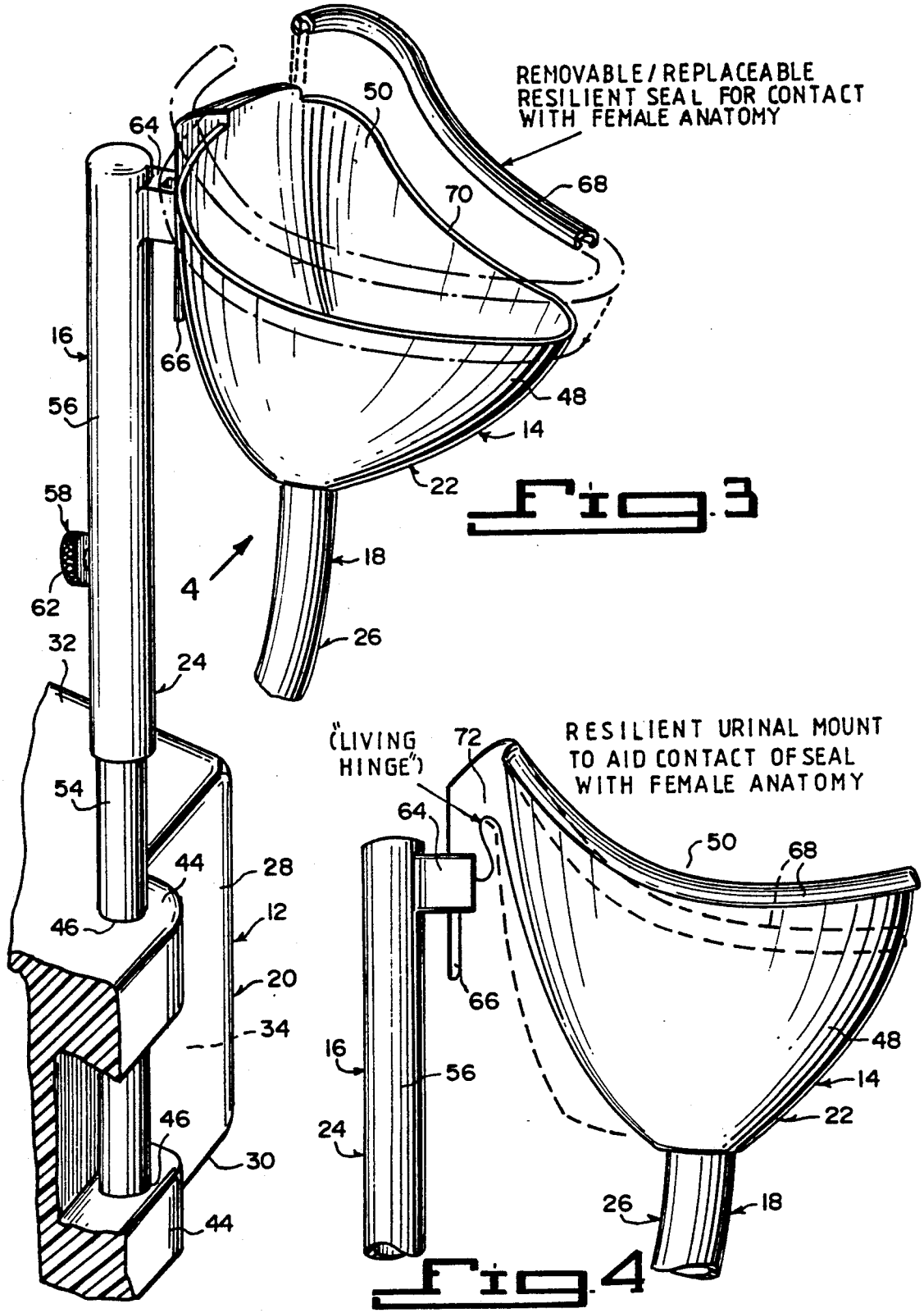
FIG. 3 is a perspective view of an upper portion of the instant invention showing a removable/replaceable resilient seal on an upper edge of the urine funnel for contact with the female anatomy..
FIG. 4 is a side view of the upper portion of the instant invention taken in direction of arrow 4 in FIG. 3, showing a resilient urinal mount to aid in contact of the seal with the female anatomy.

As best seen in FIG. 3, a removable/replaceable resilient seal 68 is at the top edge 70 at the wide open mouth 50 on the tapered housing 48 of the urine funnel cup 22 for contact with the female anatomy. A living hinge 72, as shown in FIG. 4, is formed where the hook 66 extends downwardly from the wide open mouth on the tapered housing 22 of the urine funnel cup 22 to aid in the contact of the seal 68 with the female anatomy when the urine funnel cup 22 flexes.

The improved portable urinal device 10 can be used by person in a wheelchair on a bed, the aged and by males and females. The container 20 is shown as a box, but it can be round or any other shape and not limited to the configuration shown in the drawings. The neck 36 can be located anywhere on the container 20, but preferably on the top wall 32. The container 20 can also be fabricated out of any type of durable material and can come in different sizes, colors and thicknesses.

LIST OF REFERENCE NUMBERS

10 improved portable urinal device
12 urine holding structure
14 channeling mechanism
16 suspending apparatus
18 conduit
20 container for 12
22 urine funnel cup for 14
24 stanchion for 16
26 elongated flexible tube for 18
28 upstanding side wall
30 bottom wall
32 top wall
34 chamber
36 neck on 32
38 snap on cap on 36
40 connector on 32
42 handle on 28
44 ear on 28
46 transverse hole in 44
48 tapered housing
50 wide open mouth on 48
52 externally threaded small pipe
54 elongated rod
56 sleeve
58 retaining mechanism
60 small aperture in 54
62 set screw
64 loop
66 hook
68 resilient seal
70 top edge at 50
72 living hinge on 66

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved portable urinal device which comprises:

a) means for holding urine therein, said urine holding means is a container, said container includes an upstanding side wall thereabout, a bottom wall, and a top wall, so as to form a chamber therein for holding the urine therein;

b) means for channeling the flow of urine discharged from a body of a person, said channeling means is a urine funnel cup;

c) means for suspending said urine channeling means above said urine holding means, said suspending means is a stanchion coupled between one side of said container and said urine funnel cup;

d) means for fluidly connecting said urine channeling means to said urine holding means, so that the urine discharged from the body of the person can go directly into said urine holding means, said fluidly connecting means is an elongated flexible tube extending between the bottom of said urine funnel cup and the top of said container, so as to convey the urine from said urine funnel cup into said container by the force of gravity therebetween;

e) a neck formed on said top wall of said container with said neck having an orifice for emptying the urine out of the chamber when full;

f) a snap on cap for covering the orifice of said neck;

g) a connector disposed on said top wall of said container, so that a lower end of said elongated flexible tube can be attached to said connector;

h) a handle extending from said upstanding side wall, so that said container can be carried by said handle; and i) a pair of ears spaced apart and extending from said upstanding side wall one below the other, each said ear having a transverse hole therethrough, with said holes aligned so that a lower portion of said stanchion extends through said holes to be retained by said ears.

2. An improved portable urinal device as recited in claim 1, wherein said urine funnel cup includes a tapered housing with a wide open mouth at the top and a small externally threaded pipe extending from the bottom, so that an upper end of said elongated flexible tube can be attached to said small externally threaded pipe.

3. An improved portable urinal device as recited in claim 2, wherein said stanchion is height adjustable and includes:

a) an elongated rod retained by said ears on said side wall of said container;

b) a sleeve sized to slide upon said elongated rod; and c) means for retaining said sleeve to said elongated rod.

4. An improved portable urinal device as recited in claim 3, wherein said retaining means includes:

a) said elongated rod having a plurality of longitudinal spaced apart small apertures therein; and b) a set screw threadable through a side of said sleeve to engage with any one of said small apertures in said elongated rod.

5. An improved portable urinal device as recited in claim 4, further including:

a) a loop extending outwardly from a top end of said sleeve; and b) a hook extending downwardly from the wide open mouth of said tapered housing of said urine funnel cup, so that said hook can engage with said loop to suspend said urine funnel cup therefrom.

6. An improved portable urinal device as recited in claim 5, further including a removable/replaceable resilient seal at the top edge at the wide open mouth on said tapered housing of said urine funnel cup for contact with the female anatomy.

7. An improved portable urinal device as recited in claim 6, further including a living hinge formed where said hook extends downwardly from the wide open mouth on said tapered housing of said urine funnel cup to aid in the contact of the said seal with the female anatomy when said urine funnel cup flexes.

* * * * *